United States Patent [19]

Ulm

[11] Patent Number: 5,031,676

[45] **Date of Patent: * Jul. 16, 1991**

[54] DECAP DISPENSING SYSTEM FOR WATER COOLER BOTTLES

[75] Inventor: John G. Ulm, Loveland, Ohio

[73] Assignee: Liqui-Box Corporation, Worthington, Ohio

[ * ] Notice: The portion of the term of this patent subsequent to Feb. 12, 2008 has been disclaimed.

[21] Appl. No.: 535,608

[22] Filed: Jun. 11, 1990

Related U.S. Application Data

[60] Division of Ser. No. 391,186, Aug. 9, 1989, Pat. No. 4,991,635, which is a continuation-in-part of Ser. No. 251,267, Sep. 30, 1988, Pat. No. 4,874,023.

[51] Int. Cl.[5] ..... B65B 3/04

[52] U.S. Cl. ..... 141/346; 141/349; 141/351; 141/286; 141/364; 222/146.6; 62/389

[58] Field of Search ..... 141/319-322, 141/346-354, 357, 360, 363-370, 286, 375, 376, 382-384, 1, 82; 62/389, 391; 222/146.6; 312/236

[56] References Cited

U.S. PATENT DOCUMENTS

| | | | |
|---|---|---|---|
| Re. 32,354 | 2/1987 | Savage | 222/81 |
| 488,473 | 12/1892 | Fruen | 141/352 |
| 497,896 | 5/1893 | Ruppel | 141/349 X |
| 738,712 | 9/1903 | Cole | 141/349 X |
| 757,170 | 4/1904 | Young et al. | 141/352 |
| 996,127 | 6/1911 | Patnaude | 141/363 X |
| 1,018,924 | 2/1912 | Patnaude | 141/364 X |
| 1,215,310 | 2/1917 | McCrea | 141/375 X |
| 1,228,836 | 6/1917 | Schulse | 141/375 X |
| 1,337,206 | 4/1920 | Doering et al. | 141/375 X |
| 1,538,483 | 6/1925 | Grantham . | |
| 1,931,973 | 12/1933 | Zerk | 141/357 X |
| 1,976,007 | 10/1934 | Cullen et al. | 62/143 X |
| 2,881,810 | 4/1959 | Breitenstein | 141/349 X |
| 2,989,091 | 0/1961 | Lowenthal | 141/349 X |
| 3,343,718 | 9/1967 | Siegel et al. | 141/349 X |
| 3,476,507 | 11/1969 | Leeds | 141/348 |
| 3,871,422 | 3/1975 | Elson et al. | 141/348 X |
| 4,253,501 | 3/1981 | Ogle | 141/286 X |
| 4,356,848 | 11/1982 | Spies | 141/349 |
| 4,391,308 | 7/1983 | Steiner | 141/18 |
| 4,421,146 | 12/1983 | Bond et al. | 141/349 |
| 4,445,351 | 5/1984 | Bond et al. | 141/349 |
| 4,699,188 | 10/1987 | Baker et al. | 141/286 X |
| 4,717,051 | 1/1988 | Leclerc | 222/545 |
| 4,815,493 | 3/1989 | Miller et al. | 137/454.5 |
| 4,874,023 | 10/1989 | Ulm | 141/346 |
| 4,991,635 | 2/1991 | Ulm | 141/346 |

OTHER PUBLICATIONS

Cordley/Temprite, Division of Elkay Manufacturing Company, 2222 Camden Court, Oak Brook, Ill. 60521.

*Primary Examiner*—Ernest G. Cusick

*Attorney, Agent, or Firm*—William V. Miller; Sidney W. Millard

[57] ABSTRACT

A system for supplying liquid in large bottles from a point where they are filled to a dispenser having a reservoir for receiving the liquid. The bottles each have a neck which carries a cap unit for closing the spout thereof. Each cap unit has an outlet valve that is normally closed. The reservoir has means for supporting another normally closed inlet valve in a neck-receiving socket. When the neck is slipped into the socket the outlet valve of the cap unit is opened and substantially simultaneously the inlet valve for the reservoir is opened thus allowing flow of water from the bottle into the reservoir. When the bottle is removed from the reservoir as the cap unit is withdrawn from the neck-receiving socket, the outlet valve in the bottle neck cap unit is positively closed and the inlet valve of the reservoir automatically closes.

22 Claims, 7 Drawing Sheets

13
14
55
12
63
65
64
66
67
69
72
70
71
16
76
68
72
17
62
20
21
31
88
23
87a
87
91
85
29
30
93
51
18
8
8
36
89
80
100
86a
92
83
82
81
91
86
84
97
99
31
98
95
96
68
75
74
73
61
59
15

DECAP DISPENSING SYSTEM FOR WATER COOLER BOTTLES

This is a division of application Ser. No. 391,186, filed Aug. 9, 1989 now U.S. Pat. No. 4,991,635, which is a continuation-in-part of application Ser. No. 251,267, filed Sept. 30, 1988, now U.S. Pat. No. 4,874,023.

BACKGROUND OF THE INVENTION

This invention deals with water or other liquid dispensers of the commercial type each of which has a reservoir from which the cold or hot water is dispensed. The water is supplied in a large bottle which is inverted over the reservoir so that the water flows through the spout of the bottle neck into the reservoir. In the prior art, for delivery and storage the neck is provided with a simple cap. This cap must first be removed and the bottle is then inverted and positioned over the reservoir in communication therewith. The filled bottles are very heavy and as the bottles are inverted it is usual to hold the hand over the spout to prevent loss of substantial amounts of the water. This is difficult to do and is not sanitary. The empty bottles are returned with the spout in the neck open which is unsanitary and makes them more difficult to clean and sanitize.

SUMMARY OF THE INVENTION

The present invention deals with a system whereby the water dealer can supply the water in large capped bottles each of which is closed completely and sanitarily by an outlet-slider valve in a cap applied to the neck thereof that is only opened at the time of inverting the bottle and mounting it on the water dispenser reservoir. The top of the reservoir is closed by a cover or bottle-supporting adaptor which is provided with an upwardly-opening funnel-like bottle neck receiving and supporting socket which receives and seals within it the depending valve-carrying cap on the inverted bottle. This socket carries an inlet valve which comprises a slide stem valve carrying a valve that is normally closed to seal the reservoir. As the capped bottle is inserted in the socket, the stem engages the normally-closed outlet-slider valve in the bottle cap and opens it to permit flow of water from the bottle and substantially simultaneously or an instant before, opens the reservoir sealing inlet valve to permit flow into the reservoir. When the bottle is empty and is removed by withdrawing it from the bottle neck receiving socket, the slider valve in the socket automatically closes and the stem positively activates the slider valve in the cap collar to positively close it. Thus, the bottle is positively closed before return to the dealer. Consequently, the bottle is sealed from the time of leaving the dealer when it is filled to the time of returning to the dealer empty so as to maintain sanitary conditions at all times.

The invention described above is substantially disclosed in the original application Ser. No. 201,267. The present application is directed to improvements on that invention. These include an improved cap and outlet slider valve assembly which permits increased outlet flow, an improved reservoir inlet slider stem valve and probe assembly which locks more positively with the cap outlet valve during opening and closing thereof, an improved adaptor structure for adapting the neck-receiving socket to reservoirs of different diameters, improved sealing means between the cap outlet slider valve assembly and the inlet slider stem assembly when they are in cooperative relationship in the neck-receiving socket, and improved gasket sealing means between the reservoir wall and the socket wall which is inserted therein.

BRIEF DESCRIPTION OF THE DRAWINGS

The best mode contemplated in carrying out this invention is disclosed in the accompanying drawings in which.

DETAILED DESCRIPTION OF THE DRAWINGS

Figure 1:
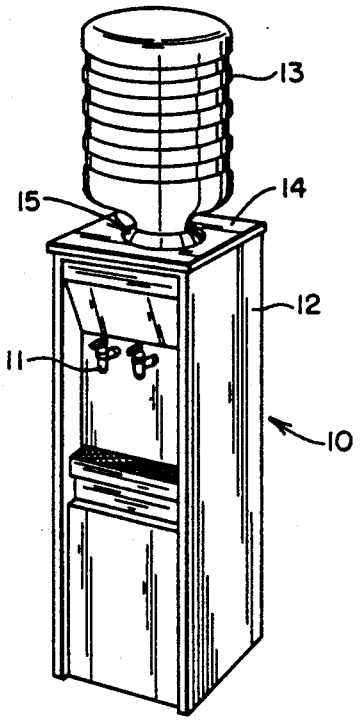
FIG. 1 is a perspective view showing a liquid dispenser to which the invention is applied.

With reference specifically to the drawings, FIG. 1 shows a liquid dispenser 10 as an example of an application of this invention. This dispenser may be of a type to cool or heat water or both and to dispense it through faucets such as 11 connected to a reservoir within the cabinet 12. Water or other liquid is supplied by large plastic or glass bottles 13 each of which is successively inserted and mounted on a cover and support plate 14 at the top of the cabinet. This plate carries an adaptor having a bottle neck receiving socket and reservoir inlet valve unit indicated generally by the numeral 15 which is located directly over the liquid or water reservoir 16 shown in FIGS. 6, 7 and 10. The reservoir is supported in the usual manner within the cabinet 12.

The bottle 13 to be inserted in the dispenser 10 is of the usual form having an elongated neck 17 which has a spout 18 which is open at the time of filling the bottle. After filling, the neck 17 receives a cap unit and outlet valve assembly indicated generally by the numeral 20. This assembly is preferably of plastic and is shown best in FIGS. 2 to 4, 4A, 8 and 9. It comprises a cap consisting of an outer flexible skirt 21 which has ribs 22 for frictionally engaging the bottle spout 18 and a flat disk-like top 23 that has a central opening 24. After filling of the bottle 13, the cap is applied and it will be noted (FIG. 4A) that it carries a tamper indicating seal 25 which is of disk-like form that is glued to the top 23 around the opening 24. It is perforated to form a radial tear tab and disc 26 so that when the tab is lifted it will indicate that the cap has been tampered with since the ring part of the seal will remain in place.

Figure 4:
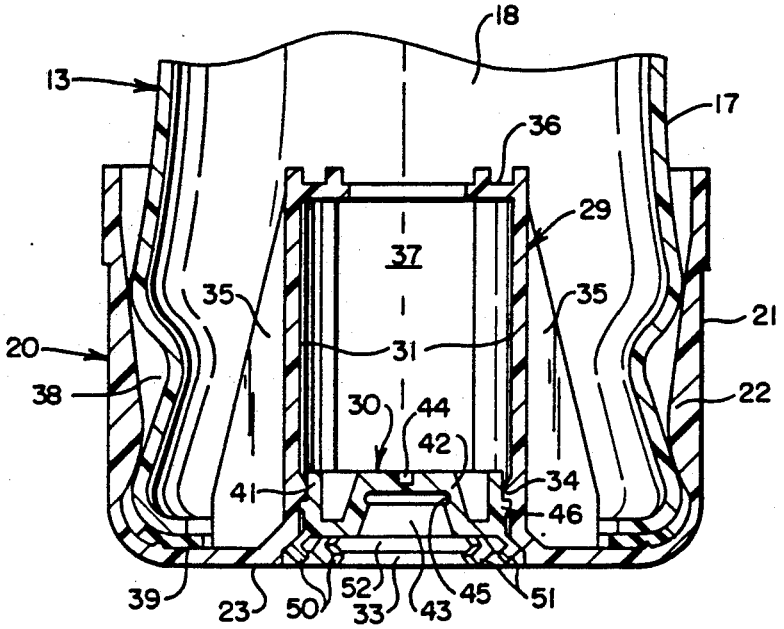
FIG. 4 is a cross section taken along 4—4 of FIG. 3.
Figure 5:
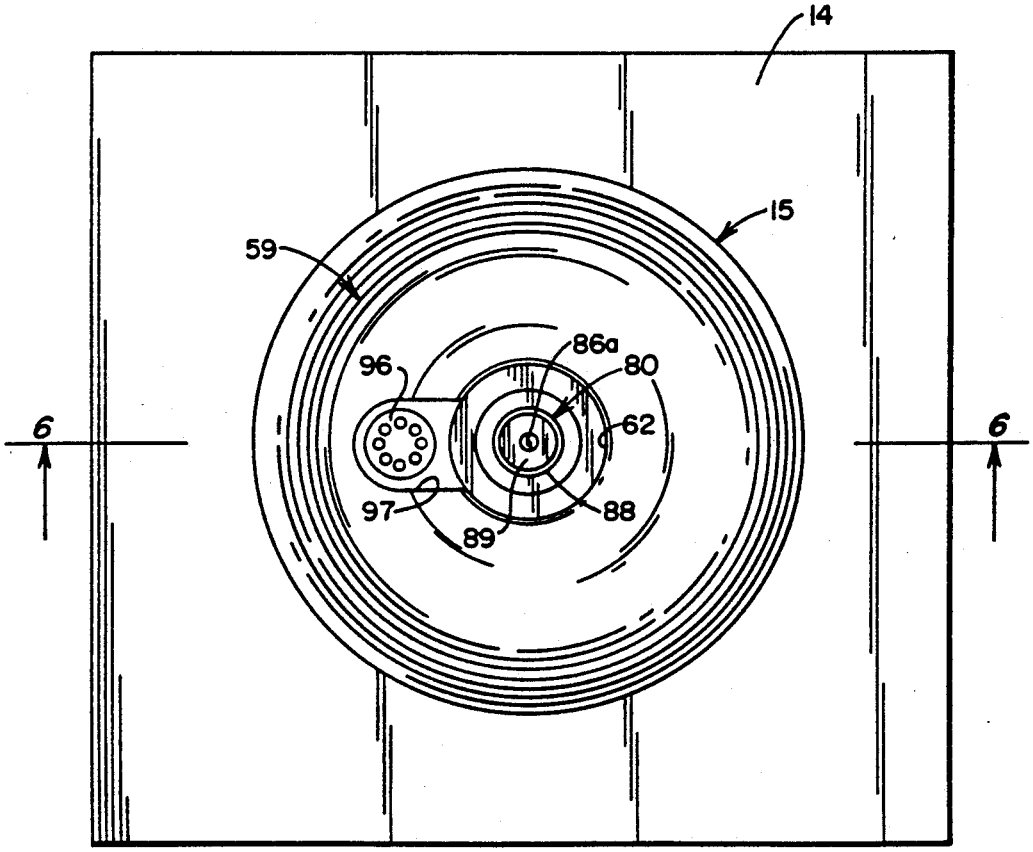
FIG. 5 is a plan view of the adaptor with its bottle-receiving socket and valve assembly mounted at the top of the reservoir of the dispenser.
Figure 3:
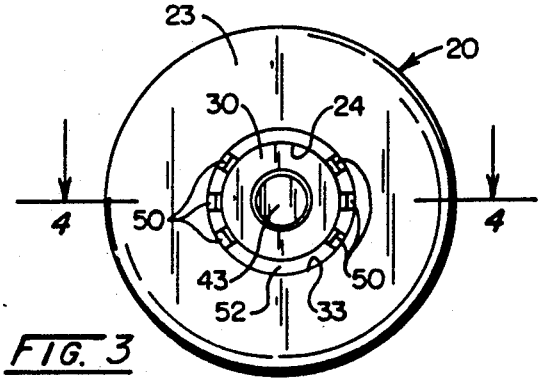
FIG. 3 is a top view of FIG. 2 without its tamper indicating seal.
Figure 3A:
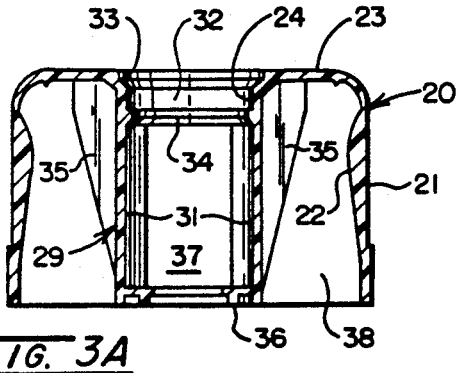
FIG. 3A is a sectional view of the socket part of the cap.

The valve of the assembly 20 comprises a slider valve member 30 which is concentrically supported in the skirt 21 for axial sliding movement by means of a guide structure 29 which includes a pair of diametrically disposed guides 31 which depend from the top 23 of the cap skirt 21. Each of these guides 31 is of arcuate cross-section (FIG. 9) and is integral with a ring 32 that surrounds the opening 24. This ring has an outwardly-flared annular cam shoulder 33 at its upper side around the opening 24 and a slider positioning groove 34 spaced axially inwardly therefrom as shown best in FIG. 3A. Each of the guides 31 is reinforced by gussets 35 extending between the guides and the top 23 of the cap. The lower ends of the guides 31 are connected integrally to a support ring 36 which is concentric with the opening 24. With this arrangement a support guide structure 29 is provided for slider valve 30 which has a pair of diametrically opposed passageways 37 between the guides 31 and it will be noted that these passageways extend the full length of the guide structure 29 so as to provide for full flow from the cap when the slider valve 30 is moved to its fully opened position shown in FIG. 7. It will also be noted that an annular spout-receiving socket 38 is provided between the skirt 21 and the gussets 35 and that this has a wide mouth but converges inwardly, so as to tightly receive the spout. A gasket 39 is provided for producing a seal at the lip of the spout 17 when the cap is positioned on the spout as shown in FIG. 4.

The slider valve 30 is of annular disk-like form to fit for sliding movement in the arcuate guides 31 and is of much less axial extent than the guides so that when moving into open position, the outlet passageways 37 will be substantially unobstructed. It comprises a body which has an outer annular guide engaging flexible flange 41 and an inner flange 42 which tapers toward its axis so as to provide an outwardly opening flared stem-receiving socket 43. The inner side of the slider 30 has a transverse slot 44 which can be used to rotate the valve member in the guide structure 29 by means of a suitable tool. The socket 43 has an annular probe-retaining groove 45 formed in its wall. On the outer surface of the flange 41 of the slider 30 is an annular rib 46 which is adapted to snap into the locating groove 34 when the slider is in closed position as shown in FIG. 4. This provides a retaining force which tends to keep the valve 30 in closed position but which can be overcome by positive inward or upward pressure on it.

The lower or outer surface of the slider valve 30 carries two sets of resilient gripping fingers 50, each set being positioned initially in alignment with a guide 31 by turning the valve so as to engage a guide as the slider is moved axially inwardly between the guides during opening. Each finger is provided with a locking lug 51 at its outer extremity. These fingers are normally biased to their outer positions in engagement with the outwardly-spaced cam surface 52 of the ring 32 to retain the slider 30 in closed position as shown in FIG. 4. The outer flange 41 of slider 30 is provided with peripheral arcuate guide flanges 43C which cooperate with the edges of guides 31 in the outlet passageways 37 (FIG. 9) to prevent rotation of the slider once it is positioned properly within the guide structure 29 so that the sets of gripping fingers 50 are located properly to cooperate with the guides.

Figure 6:
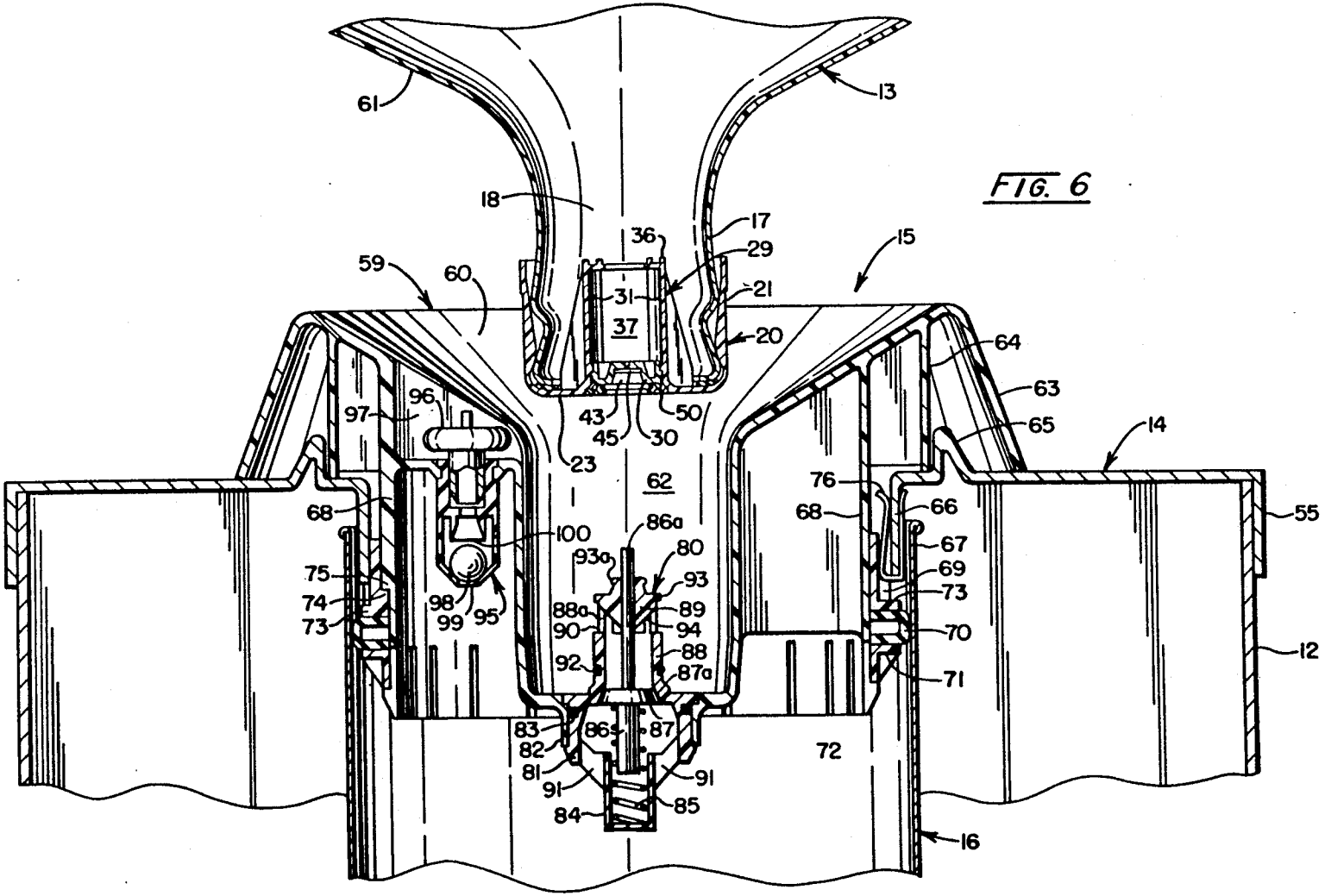
FIG. 6 is an enlarged sectional view taken along line 6—6 of FIG. 5 showing the capped bottle being inserted in the socket above the reservoir.
Figure 7:
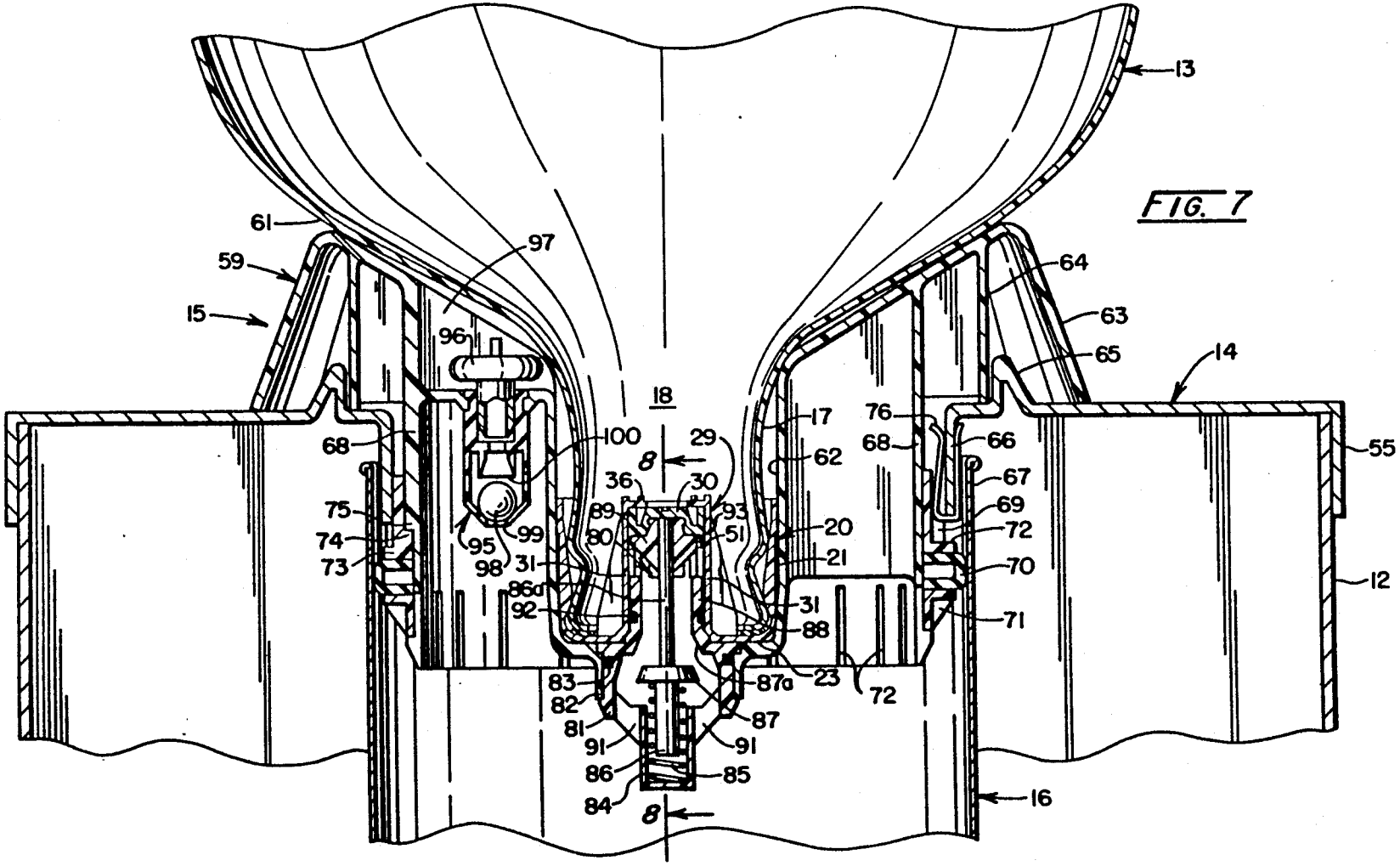
FIG. 7 is a similar view showing the inserted bottle in the receiving socket on the adaptor.
Figure 8:
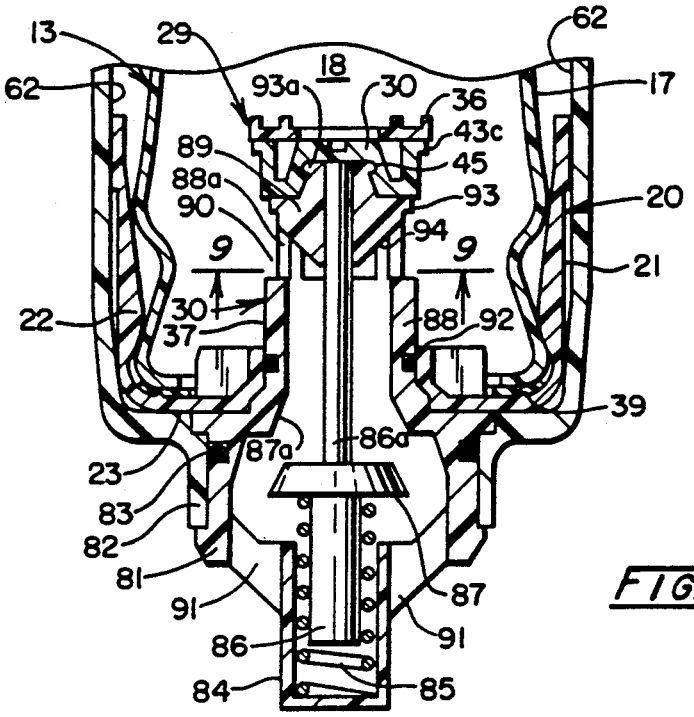
FIG. 8 is an enlarged sectional view taken along line 8—8 of FIG. 7 through the reservoir inlet valve.
Figure 9:
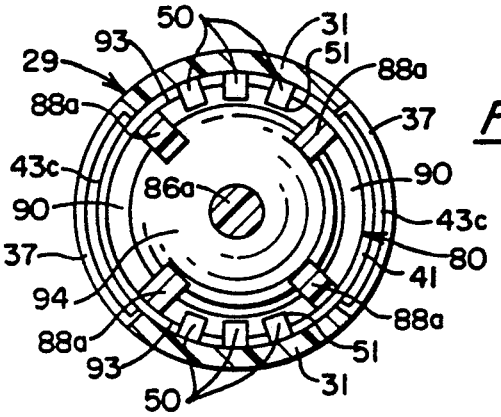
FIG. 9 is a section taken along line 9—9 of FIG. 8.

As indicated, the cover and support plate 14 is adapted to support the bottle neck 17 in association with the reservoir 16 as shown in FIG. 7 after insertion of the bottle in the socket and valve assembly unit 15 from the position shown in FIG. 6. This plate 14 has a depending peripheral flange 55 which extends downwardly into overlapping relationship with the wall of cabinet 12 and may be suitably secured thereto as shown in FIGS. 6 and 7. This plate supports the bottle neck socket and associated reservoir inlet valve assembly unit 15 as previously indicated. This unit which is preferably of plastic is of funnel form and comprises an adaptor 59 with upper adaptor portion 60 which will receive and support the curved upper portion 61 of the bottle 13 which merges with the neck 17 of the bottle. It will be obvious that this portion 60 of the adaptor can receive and support bottle portions 61 of various diameters. The adaptor portion 60 merges with the depending neck-receiving socket 62 which is of tubular form. The adaptor 59 is provided with a pair of depending annular outer flanges 63 and 64 which rest in the plate 14 on opposite sides of an upstanding annular centering rib 65 which engages the flange 64 to center the adaptor relative to the reservoir 16 flange 63 being angled outwardly radially. Radially inwardly of the rib 65 the plate 14 has an annular depending skirt 66 which depends into the reservoir 16 into overlapping relationship with its annular wall 67. The adaptor 59 also has a depending annular skirt 68 which extends downwardly into the reservoir 16 in spaced relationship to the wall 67 thereof so that the space can receive the annular C-shaped gasket 70 which is adapted to be expanded into sealing engagement with the reservoir wall 67 and the adaptor skirt 68 as shown best in FIG. 10. This gasket has its lower side in engagement with a support and pressure ring 71 that is carried by skirt 68. Skirt 68 is provided with vertical slits 72, although wider slits may be provided, to facilitate positioning of the gasket initially on the skirt. The upper side of the gasket 70 is engaged by a cam ring 73.

Figure 10:
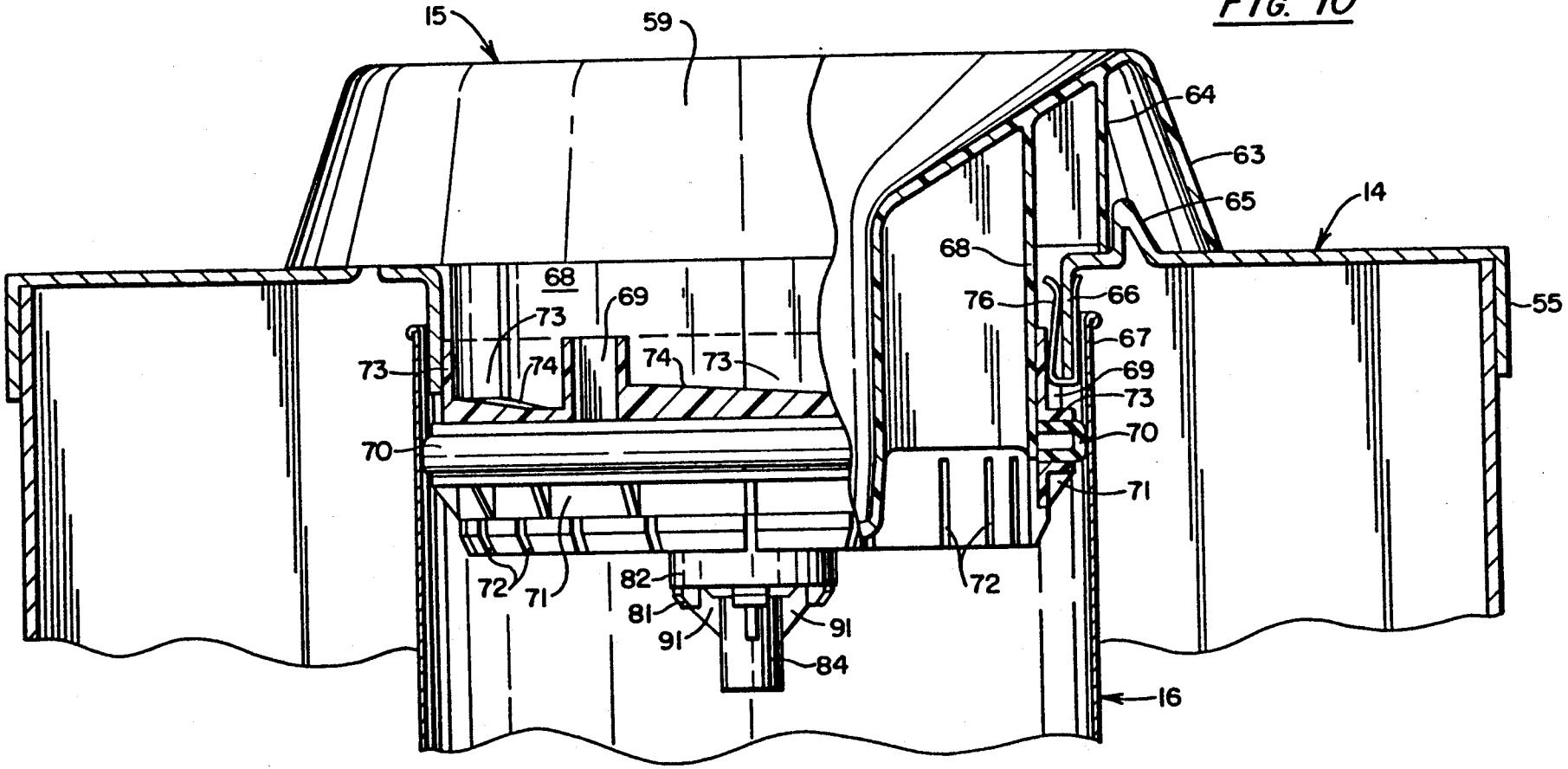
FIG. 10 is a partial sectional view of the bottle-receiving adaptor.

The spacing of the skirt 68 within the surrounding concentric wall 67 of the reservoir 16 may vary in different models of dispensers, and means is therefore provided to expand the gasket 70 carried by skirt 68 into contact with the surrounding reservoir wall to provide a tight hermetic seal. For this purpose means is provided for producing relative axial sliding movement of the cam ring 73 on the skirt 68 after the unit 15 is initially positioned on plate 14 over the reservoir 16. This will cause the gasket 70 to be compressed vertically to expand it radially outwardly into tight contact with the wall 67 of reservoir 16 as shown in FIGS. 6, 7 and 10. This may be accomplished by means of inclined cams 74 on the ring 73 and reversely inclined cams 75 on the skirt 68 so that if the adaptor 59 is rotated the gasket will be compressed since depending clips 76 are provided on depending flange 66 of the adaptor and within notches 69 of cam ring 73 to prevent rotation of cam ring 73 when the adaptor is rotated relative to the reservoir.

As indicated previously, the unit 15 includes the neck-receiving socket 62 and this socket has mounted at its bottom a reservoir inlet valve indicated generally by the numeral 80 in FIGS. 6, 7, 8 and 9. The valve is carried by a fitting 81 which is mounted on a boss 82 at the bottom of the socket 62 and is sealed therein by an O-ring 83. This fitting has a depending chamber 84 in which a compression spring 85 is disposed that has an upper portion surrounding the lower end of a valve stem 86. This stem 86 is part of a slider valve which includes a valve head 87 that is normally seated by the spring 85 on a valve seat 87*a* in an upstanding probe support tube 88 of fitting 81 which surrounds the reservoir inlet opening. The stem 86 has a reduced upward extension 86*a* above the valve head and this slidably extends through a probe head 89 fixed on the upper end of tube 88 by four post 88*a* forming inlets 90. This tube provides a probe extending upwardly into the neck-receiving socket 62 and which carries the head 89 for activating the slider valve 30 in the manner described below. The probe head has an annular shoulder 93 projecting outwardly and has a tapered lower surface 94 below it for directing liquid through the inlets 90 provided below the probe head. Liquid will flow through these inlets from the opened valve 30 and, when the valve head 87 is unseated, past the valve head 87 and through inlet openings 91 at the bottom of fitting 81 into the reservoir 16. When the valve head 87 is seated the stem 86 will project upwardly through the probe head 89 as shown in FIG. 6. An O-ring 92 is mounted on tube 88 adjacent the bottom of socket 62.

An air filter and check valve unit 95 is located on the adaptor 59. The filter 96 is in an open chamber 97 at the upper side of the adaptor for admitting air when needed. The ball 98 of the check valve normally rests on a lower seat 99 but if the liquid level rises in the reservoir it will float and seat on an upper seat 100 to prevent overflow from the reservoir 16. Different types filter and check valve units may be provided.

Figure 4A:
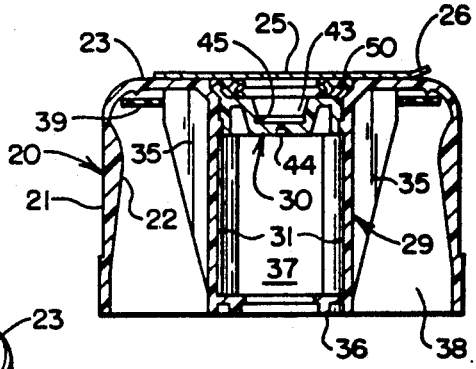
FIG. 4A is a sectional view of the assembled cap.
Figure 2:
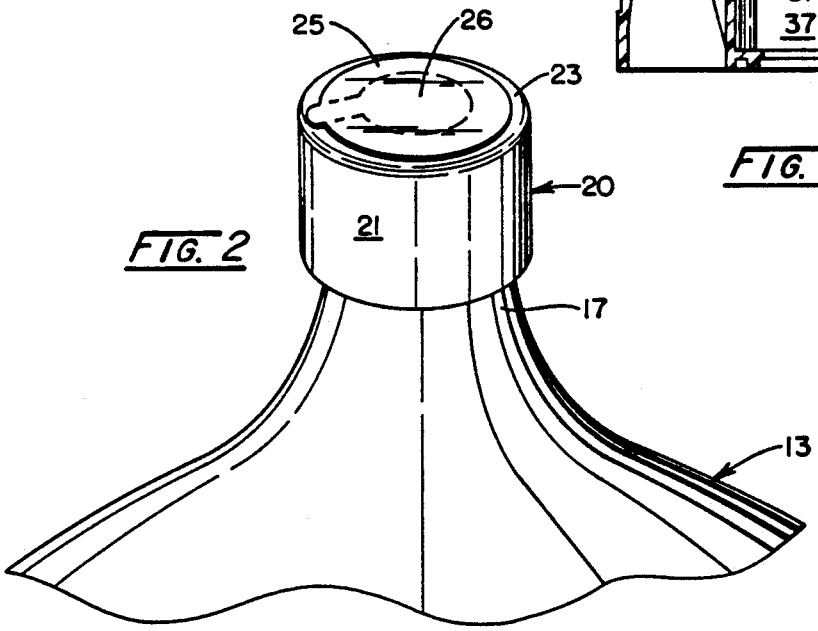
FIG. 2 is an enlarged view of the neck portion of one of the bottles with the cap and valve assembly of the invention applied thereto.

In use of the system, the bottle 13 is filled and the cap and valve unit 20 is then applied by forcing it onto the neck 17. Before applying to the bottle, the unit 20 will be as shown in FIG. 4A with tamper indicating seal 25 in place. The cap 20 contains the slider valve 30 which will be closed at this time with the fingers 50 in engagement with cam surface 52. As indicated initially, the slider valve 30 is rotated about its axis by a tool applied to slot 44 to position the locking fingers 50 for cooperating with guides 31 and to snap the peripheral flanges 43C into passageways 37 to be retained by the edges of guides 31. Thereafter, valve 30 will remain in this rotated position even when sliding vertically on guides 31. The cap and valve 20 on the bottle assures minimum leakage and maximum sanitation during storage and dispensing.

The bottle neck receiving socket and reservoir inlet valve unit 15 is applied to the reservoir 16 initially by positioning the adaptor 59 on the plate 14 with the skirt 68 thereof extending into the reservoir as shown in FIG. 6. The adaptor is then rotated on the plate 14 to compress the gasket 70 as indicated. This causes the gasket to expand radially to tightly seal between the wall 67 of the reservoir 16 and the skirt 68 of the adaptor 59 to hermetically seal the unit 15 in the reservoir 16. At this time the valve stem 86 is biased by the spring 85 so that the valve head 87 is seated and the stem extension projects upwardly from the probe head 89. The check valve 98 will close to prevent overflow from the reservoir 16 if necessary. Air will be admitted as needed through filter 96. This air handling system is important for controlling reservoir overflow which may be caused after the bottle neck is inserted in unit 15 by cracked bottles admitting make-up air. If the crack is located on the bottle so it will admit air without leaking liquid, the liquid will not exit the reservoir 16 and overflow because of the hermetic seal between the reservoir 16 and the unit 15 which is also maintained at the valve 95 until make-up air is needed.

In positioning the filled and capped bottle 13 on the unit 15 carried by plate 14, the bottle 13 is inverted as shown in FIG. 6 and is positioned centrally over the upper adaptor portion 60 and, as the bottle is lowered, the neck 17 will be guided thereby into the neck-receiving socket 62. At this time the reservoir inlet valve 80 will be closed with valve body 87 seated and the stem 86*a* projecting upwardly through probe head 89. As the neck 17 drops into the tubular socket 62 it fits tightly therein to prevent tilting of the bottle since the cap skirt 21 will frictionally engage the tubular wall of the socket. The neck will drop in until the cap top 23 rests on the bottom of the socket 62 as shown in FIG. 7. As the bottle neck 17 passes down into the socket 62 the upper end of the valve stem 86*a* enters the downwardly opening socket 43 in slider valve 30 which moves the valve head 87 off the seat 87*a*. The probe head 89 then snaps into the slider valve 30 pushing it up. In doing this the flexible gripping fingers 50 are engaged by the cam surface 52 of the ring 32 to swing them radially inwardly and they will be held in this position by the valve 30 sliding along the guides 31 with its two sets of fingers in engagement with the surfaces of guides 31. It will be apparent that valve 30 is positively held in closed position (FIG. 4) until the fingers 50 swing radially inwardly. Upward movement of valve 30 by probe head 89 opens the passageways 37 so that liquid can flow through said passageways and downwardly through the cap ring 32. As opening of valve 30 occurs, the socket 43 of the valve 30 moves downwardly over the probe head 89 until its retaining ring 93*a* snaps into the retaining groove 45 on the valve. Thus, probe head 89 is positioned in socket 43 unless positively pulled therefrom. At the same time the locking lugs 51 on the flexible fingers 50 are swung beneath the annular shoulder 93 on the probe head 89 to positively lock the valve 30 to the probe head. Thus, the slider valve 30 is first opened by contact of the upper end of the probe head 89 therewith and slightly before that the valve 87 is unseated by stem 86 by contacting valve 30 to permit the liquid to flow from the bottle 13 through relatively unrestricted passageways 37 and then out through tube (FIG. 8) 88 past unseated valve head 87 to the reservoir through the inlets 91. As the valve 30 moves upwardly in the guides 31 they move down over the O-ring 92 to provide a seal between those members.

When the bottle is removed by pulling its neck 17 upwardly from the socket 62, the spring 85 moves the stem 86 automatically upwardly to seat the valve head 87 and the slider valve 30 is moved positively into closed position by the interfitting valve probe 89 positively pulling the valve 30 axially outwardly into closed position due to its positive connection thereto through the gripping fingers 50 having their locking lugs 51 positioned beneath the projecting shoulder 93 on the probe head 86 and the snap fit of the retaining ring 93*a* in the groove 45 of the socket 43 in valve 30. Thus, the outlet valve 30 in the cap 20 is positively closed when the bottle 13 is removed from the reservoir 16. Consequently, the clean and sanitary facilities are continued after the bottle 13 is empty and removed from the dispenser 10 in that the cap valve 30 is closed and deters the invasion of vermin, insects and bacteria. Bottles returned with the cap 20 removed will immediately cause suspicion as to the possibility that the bottle has been used to contain other undesirable liquids. The cap 20 is designed to be almost impossible to remove intact but may be removed by a suitably designed decapitator.

It will be apparent from the above that this system uses a cap and valve assembly which hermetically seals the bottle until it is to be positioned in cooperation with the reservoir of the dispenser. This cap assembly includes the normally-closed bottle outlet valve in the form of a slider valve member. The cap outlet valve is automatically opened when the neck of the inverted bottle is inserted into a socket leading into the reservoir and becomes hermetically sealed in that socket. That socket is provided with a slidable valve stem to engage the cap slider valve to open it and which also controls substantially simultaneously the unseating of a reservoir inlet stem valve to permit flow of liquid from the bottle into the reservoir. When the bottle neck is withdrawn from the reservoir socket, the slider valve in the cap is positively moved to closed position and the reservoir inlet stem valve is allowed to close.

Figure 11:
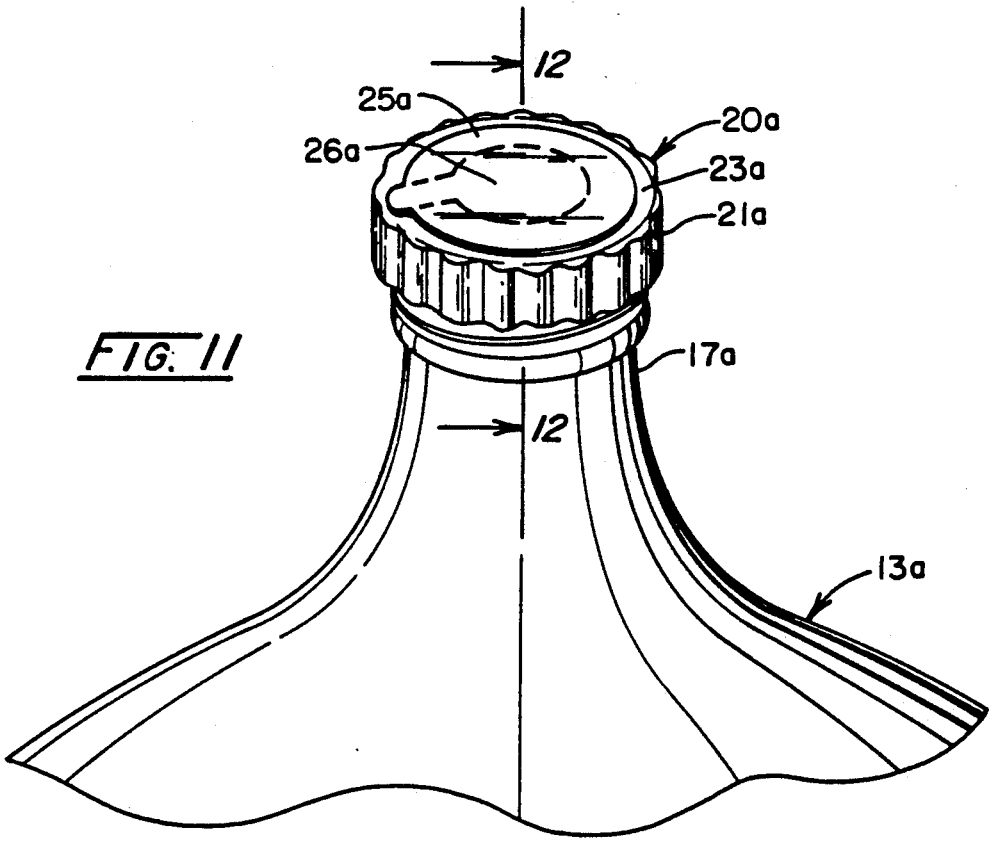
FIG. 11 is a perspective view of the neck of a bottle with a screw cap thereon which carries the outlet valve assembly.
Figure 12:
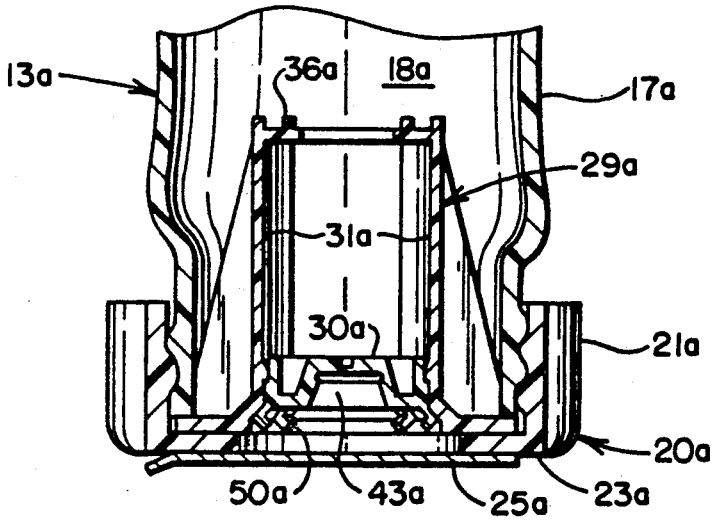
FIG. 12 is an enlarged sectional view taken along line 12—12 of FIG. 11.

In FIGS. 11 and 12 the cap and outlet valve unit 20*a* is shown as comprising a screw cap 21*a* which screws onto the threaded neck 17*a* of the bottle 13*a*. The slider valve 30*a* is exactly as before and slides in the guides 31*a*. Corresponding numbers with a suffix "a" designate similar parts. The function will be the same as the valve previously described.

Figure 13:
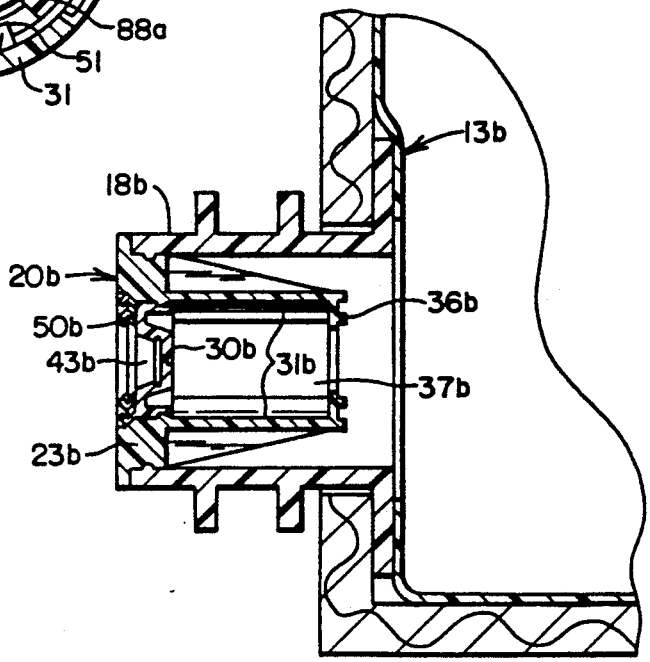
FIG. 13 is a section showing a bottle outlet valve assembly mounted in the spout of a bag-in-box.

FIG. 13 illustrates the outlet valve structure 20*b* disposed directly within a spout 18*b* which may be on a bag 13*b* of a bag-in-box package. The slider valve 30*b* is exactly as before but may be carried by a disk 23*b* which is snapped into the end of the spout 18*b*. Other parts similar to the previously described assembly are indicated by corresponding numerals with the suffix "b". This valve functions the same as those previously described.

This system provides a method whereby the bottle is hermetically sealed after filling and until it is mounted on the top of the dispenser reservoir which itself is hermetically sealed until the neck of the bottle is inserted in the socket associated therewith. At that time the outlet valve on the bottle is automatically opened while substantially simultaneously the inlet valve for the reservoir is opened. Upon removal of the bottle from the dispenser the inlet valve of the reservoir closes and the outlet valve of the bottle is positively closed. Thus, sanitary conditions are maintained from the filling of the bottle until its return.

What is claimed is:

1. A cooperating valve and probe combination in which said valve comprises an outlet slider valve for sliding movement between a normally closed position and an opened position, a guide structure for supporting said outlet slide valve for the sliding movement and having a length with elongated outlet passages, said outlet slider valve having a length of substantially lesser extent than said passages to permit flow therethrough as the valve moves toward opened position, said valve carrying resilient gripping fingers for engaging the guide structure to normally hold the valve in closed position, means for preventing rotation of said valve in said guide structure to prevent displacement of said fingers relative to said guide structure and said probe being adapted to engage said valve to move said valve into said opened position.

2. The combination of claim 1 in which the guide structure comprises a ring support carrying elongated guides which are annularly spaced to provide said passages therebetween, said guides having arcuate surfaces, said outlet slider valve being of annular form to engage said surfaces.

3. The combination of claim 2 in which said means for preventing rotation of said outlet slider valve comprises guide shoulders engaging said elongated guides to prevent rotation of said annular outlet slider valve.

4. The combination of claim 3 in which said shoulders are provided by an arcuate peripheral flange projection on said annular outlet slider valve which fits between the elongated guides at each passage.

5. The combination of claim 4 in which said ring support and said annular outlet slider valve have interengaging means tending to hold the annular slider valve in closed position.

6. The combination of claim 4 in which said elongated guides consist of a pair of diametrically opposed guides on said ring support with diametrically opposed passages therebetween.

7. The combination of claim 5 in which said interengaging means is in the form of a cooperating groove and a rib snapped into the groove.

8. The combination of claim 5 in which said annular slider valve carries said resilient fingers for engaging said ring support to normally hold the valve in closed position.

9. The combination of claim 1 in which said guide structure comprises elongated guides which are of arcuate cross-section and are carried by an outer ring on said ring support having an outlet opening normally closed by said slider valve, said resilient fingers being biased to engage said outer ring to normally hold the outlet valve in said closed position.

10. The combination of claim 9 in which the fingers are flexibly connected at inner ends to said outlet slider valve and have probe-engaging locking lugs on their outer ends.

11. The combination of claim 10 in which said outlet slider valve has an outwardly opening probe-receiving socket at its outer side.

12. The combination of claim 11 in which said socket has a probe retaining groove in a wall thereof for receiving a rib on said probe.

13. The combination of claim 10 in which the fingers are in two diametrically opposed groups on said slider valve, said guides comprising a pair of guides supported by said ring at diametrically opposed locations corresponding to the locations of said groups of fingers.

14. The combination of claim 13 in which said fingers are normally biased outwardly into engagement with said ring, said ring having a cam surface which engages said fingers as they move inwardly with said slider valve when it is opened.

15. The combination of claim 14 in which the said elongated guides have edges exposed at said outlet passages, said slider valve having a peripheral projection engaging said edges at each of said outlet passages.

16. The combination of claim 15 in which the valve is of disk form with a probe head receiving socket at its outer side, said probe having a head on a support, an inlet slider valve mounted in said support and including a stem which carries a valve for seating on a valve seat on said support inwardly of said head, said support having liquid flow openings axially outwardly of the valve seat, said stem projecting slidably outwardly through the probe head, and means for biasing the stem carried valve on its seat.

17. The combination of claim 16 in which said probe head is adapted to fit into said outwardly opening probe head receiving socket in said outlet slider valve upon movement of the head axially outwardly into contact with the valve, said stem projecting slidably axially through said head so that it will extend into said probe head receiving socket before the probe head enters therein upon said movement.

18. The combination of claim 17 in which said probe head has locking means engaged by said resilient gripping fingers carried by said annular outlet slider valve as it is pushed axially into said opened position by said stem.

19. The combination of claim 18 in which the locking means is on said probe head and is engaged by locking lugs on said fingers.

20. The combination of claim 19 in which said locking means comprises an annular shoulder on the head for engagement with said lugs.

21. The combination of claim 20 in which said resilient fingers are normally biased to engage said ring and hold the slider valve in closed position, said ring having a cam surface for moving the locking lugs into locking engagement with said locking means on the probe head as the probe head pushes the annular outlet slider valve axially into said opened position.

22. The combination of claim 20 in which the probe receiving socket of the annular valve and the probe head have interengaging means tending to hold the probe head in the socket.

* * * * *